United States Patent [19]

King

[11] Patent Number: 5,052,350

[45] Date of Patent: Oct. 1, 1991

[54] DEVICE TO COMBINE THE MOTIONS OF TWO CAMLOBES DIFFERENTIALLY PHASED

[76] Inventor: Brian T. King, 48000 Elkview Road, Sardis, BC, Canada, V2R 1B1

[21] Appl. No.: 608,562

[22] Filed: Nov. 2, 1990

[51] Int. Cl.[5] ..... F01L 1/34

[52] U.S. Cl. ..... 123/90.16; 123/90.27

[58] Field of Search ..... 123/90.15, 90.16, 90.27, 123/90.39, 90.41, 90.44, 90.47

[56] References Cited

U.S. PATENT DOCUMENTS

| | | | |
|---|---|---|---|
| 1,885,796 | 11/1932 | Boulet | 123/90.15 |
| 4,768,475 | 9/1988 | Ikemura | 123/90.16 |

FOREIGN PATENT DOCUMENTS

| | | | |
|---|---|---|---|
| 3725448 | 2/1989 | Fed. Rep. of Germany | 123/90.15 |
| 2202584 | 9/1988 | United Kingdom | 123/90.16 |
| 2206380 | 1/1989 | United Kingdom | 123/90.16 |
| 2206647 | 1/1989 | United Kingdom | 123/90.16 |

*Primary Examiner*—Willis R. Wolfe
*Assistant Examiner*—Weilun Lo

[57] ABSTRACT

A mechanism for combining, so as to reconcile in a dynamically acceptable manner, the valve actuating displacement of a pair of camlobes rotating at variable relative phasings so as to vary the duration of a valve; the mechanism comprising a first lever having a first cam follower to engage a first camlobe, a second cam follower to engage a second camlobe, and a fulcrum to rotatably engage a means to actuate a valve; the means to actuate a valve comprising variously i) a bucket tappet having a fulcrum to rotatably locate the first lever, ii) a second lever rotating about a fulcrum, having a fulcrum to locate rotatably the first lever, and extension/s to engage operatively a valve/s.

7 Claims, 9 Drawing Sheets

PRIOR ART VARIATOR

PRIOR ART VARIATOR

DEVICE TO COMBINE THE MOTIONS OF TWO CAMLOBES DIFFERENTIALLY PHASED

BACKGROUND OF THE INVENTION

It has long been recognised in the art that non-variable valve duration in a four cycle internal combustion engine is a serious impediment to optimal engine efficiency, and in view of this deficiency many systems have been proposed to provide continually variable valve duration.

One class of system proposed has been to employ various mechanisms in which the opening flank of a first camlobe opens the valve, while the closing flank of a second camlobe controls the closing of the valve, and by variably indexing the first and second camlobes relative to each other, achieving a variation in the duration of the valve.

A serious problem with this approach is with regard to the reconciliation of valve motion at the point in the valve lift curve where the opening and closing lobe flanks effectively meet. At any worthwhile extension of duration, a dynamically unacceptable unevenness in the curve of valve lift develops, as depicted in FIG. 6.

A solution often proposed to solve this problem has been to employ a pair of camlobes with broadly flattened "tips" defined by a radius rotated about the cam axis, thereby allowing a continuous transition from one lobe to the other at more extended durations.

The benefits of this approach are largely illusory, since a camlobe with such a broad "tip" has, of necessity, a very long duration, rendering the minimum duration the system can transmit to the valve excessive; or, if the duration of the lobe is usefully short, pushing valve accelerations beyond any acceptable levels.

A further serious limiting factor in camlobe design which prevents realisation of optimal valve action, both in systems which seek to vary valve duration, and in non-variable designs, is the necessity, in camlobe design, to limit valve accelerations (both positive and negative) to those that will be developed at the highest r.p.m.'s the engine will attain in use. Unfortunately, the use of a camlobe profile that will develop maximum allowable valve accelerations at high r.p.m. will result in less than optimum valve opening and closing rates at all engine speeds below that maximum. In short, the rate of valve opening and closing should ideally increase progressively as engine speed drops, this being possible by virtue of the increasingly longer time available to open and close the valve as engine speed decreases. The result of such an ideal state of affairs would be to substantially increase cylinder filling at all engine speeds; the higher volumetric efficiency resulting producing a much improved torque curve, and superior power characteristics. Perhaps more importantly, at the present time, is the fact that the realisation of both of the above factors of fully variable valve duration, and variable rates of valve opening and closing, would offer a predictable baseline of engine induction and exhaust characteristics upon which to base development of fuel economy and emission control factors.

Accordingly, a mechanism is proposed to provide a means, when used in conjunction with any suitable system employing two camlobes with variable phasings between them to actuate a valve at variable durations, to reconcile the motions of said camlobes; and to vary, towards an optimum value, rates of valve opening and closing according to engine speed.

SUMMARY OF THE INVENTION

It is an object of the present invention to provide a mechanism which will reconcile the motion of the opening flank of a first camlobe with the motion of the closing flank of a second camlobe when said camlobes are variably indexed relative to each other for the purpose of varying the duration of a valve of an internal combustion engine.

It is another object of the present invention to provide a means to vary, so as to tend to optimise, rates of valve opening and closing throughout the operating range of an internal combustion engine.

To achieve these objects, it is necessary that the present invention be applied to a mechanism capable of variably indexing a pair of camlobes to vary valve duration; the inventor's co-pending applications Ser. Nos. 07/496,651 and 07/544,180 being of this description.

The mechanisms embodied in the aforesaid applications will receive here only cursory description, the full description being available elsewhere.

Substantially, the aforesaid mechanisms shown in FIGS. 2 and 8 comprise means to variably index a pair of camlobes relative to each other, and relative to crankshaft revolution. The camlobes are sufficiently adjacent to each other to serve the same cylinder, and either share a common axis, or have axis parallel to each other. The camlobes, by virtue of being individually connected to the same camshaft/camshaft pulley by means of helical splines, and responsive to actuation means, may be so actuated, during normal rotation of the camshaft pulley, as to advance one camlobe relative to camshaft pulley rotation, while retarding the other camlobe relative to camshaft pulley rotation, thereby providing an opening flank of a first camlobe advanced relative to pulley rotation, and a closing flank of a second camlobe retarded relative to pulley rotation; the advanced opening flank and the retarded closing flank effectively defining cooperatively an extended camlobe duration with which to control a valve.

It should be noted that all of the mechanisms of the present invention summarized here operate on substantially the same principle in reconciling the motions of two camlobes at disparate phasings so as to actuate a valve; only the means of transmitting this motion to the valve differing from one mechanism to the next.

The mechanism to reconcile the aforesaid motions comprises a camfollower to engage each of the aforesaid camlobes, the camfollowers being connected by a lever. The camfollowers may be either rigidly attached to the lever, or alternately, attached so as to be capable of limited rotation relative to the lever; the aforesaid being determined according to whether the axis of the camlobes are separate and parallel, or of common axis, and necessitated by the need to maintain proper contact berween camlobe and follower at all times.

Located substantially midway between the camfollowers is a fulcrum about which the lever may rotate, the fulcrum providing the attachment point between the lever and the means for actuating the valve.

It will be seen that when the two camlobes are differentially phased so as to extend valve duration, rotation of the camshaft will bring the advanced camlobe into contact with a first of the camfollowers while the base circle of the retarded camlobe is still in contact with the second camfollower, the resulting displacement of only one camfollower causing the lever to rotate about its axis, while the axis undergoes linear displacement. By this means, the lift generated by the two camlobes is "averaged" at the fulcrum, and it is this feature that eliminates the unevenness of valve motion that normally occurs when two camlobes at disparate phasings cooperatively control valve motion.

The various means for transmitting this "averaged" motion from the fulcrum of the lever as hereinbefore described to the valve are as follows:

I. The fulcrum of the lever is rotatably located by extensions of a bucket tappet.

II. The fulcrum of the lever is rotatably located by an extension of a second lever rotating about a fixed axis at right angles to the axis of the lever, and having means to actuate a valve, or valves.

III. The fulcrum of the lever is located on a second lever rotating about an axis parallel to the axis of the lever, the second lever having means to actuate a valve or valves.

IV. The fulcrum of the lever is mounted to a reciprocating member received in a housing fixed relative to the engine.

DETAILED DESCRIPTION OF THE PREFERRED EMBODIMENTS

Figure 1:
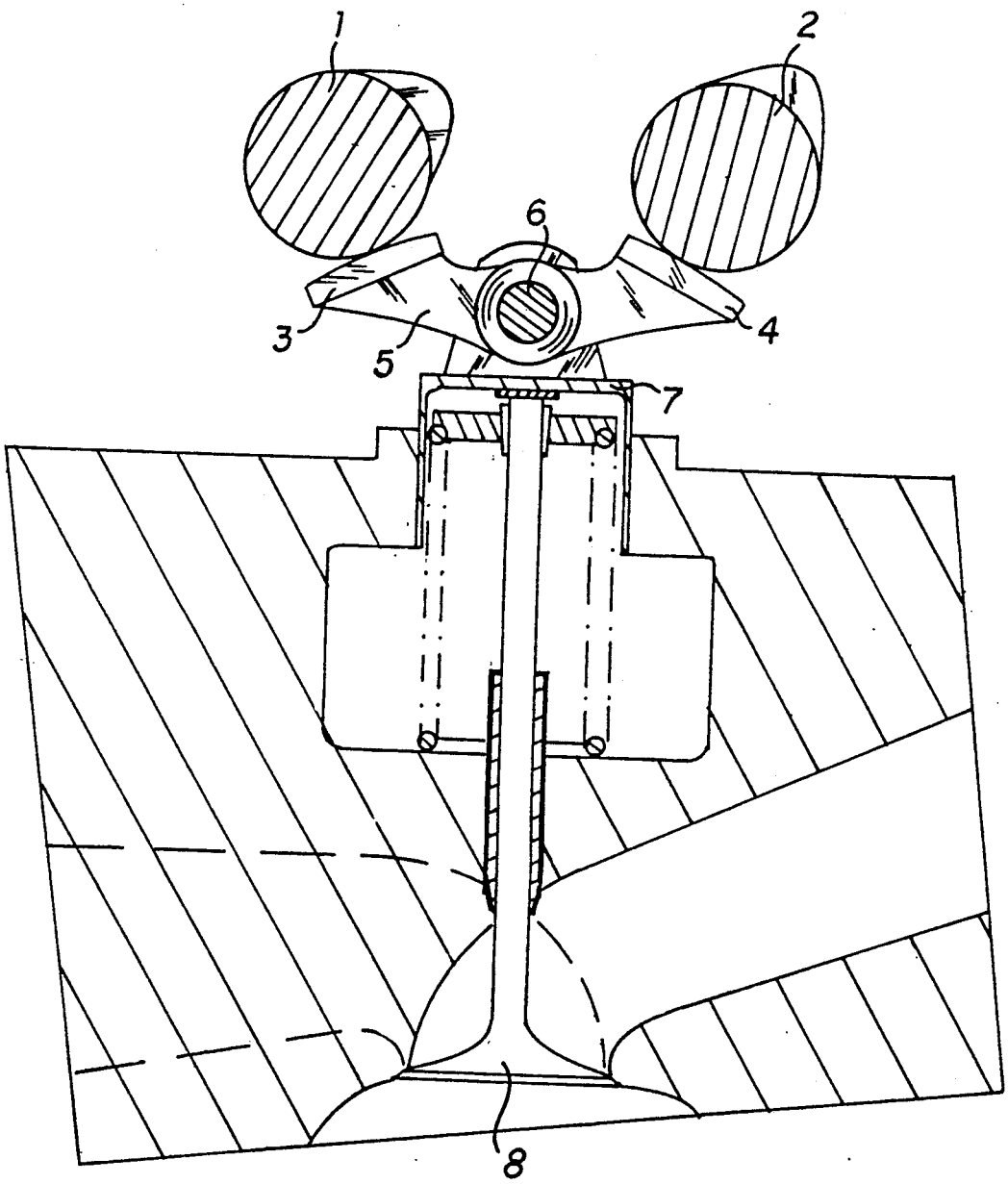
FIG. 1. Shows a version of the present invention.
Figure 2:
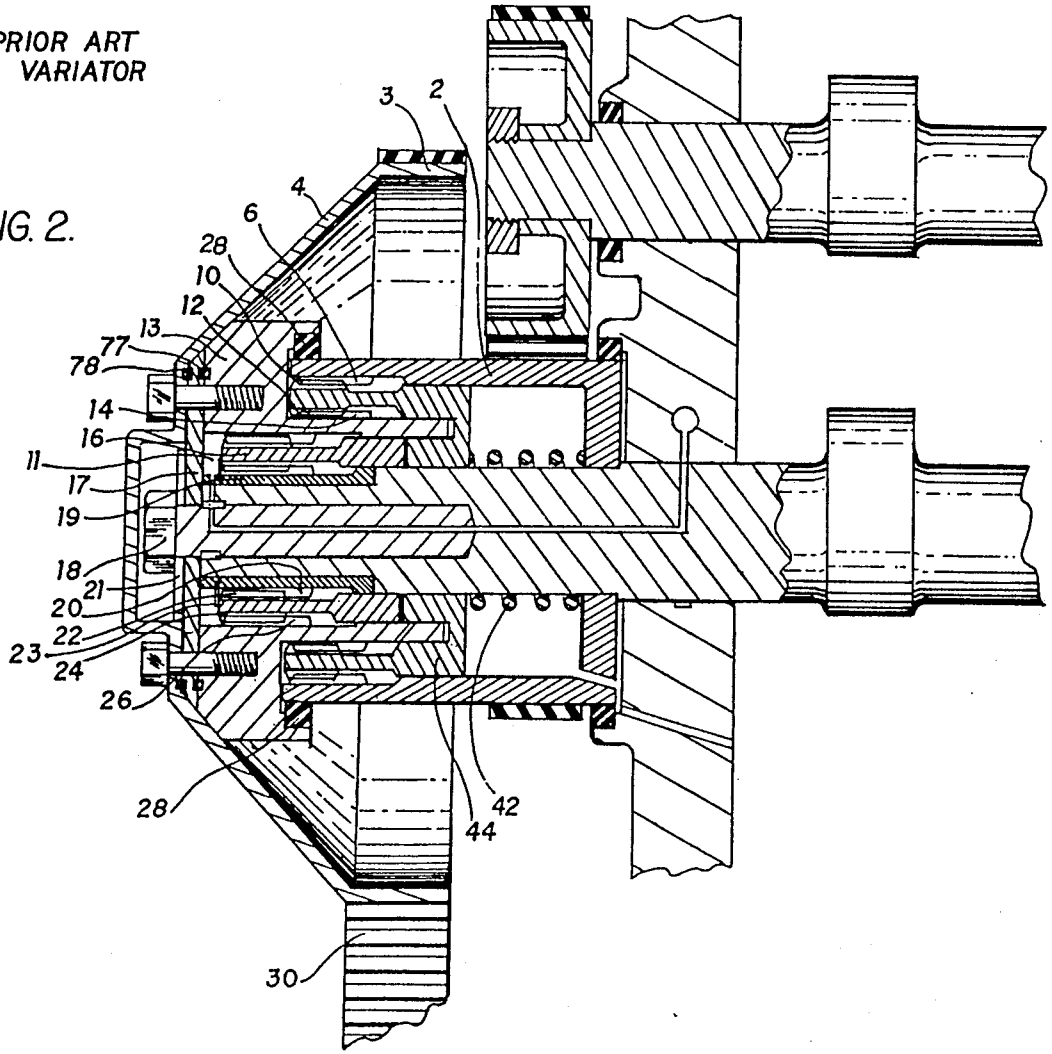
FIG. 2. Prior Art mechanism which may be used to actuate the present invention.

A preferred embodiment of the present invention is shown in FIG. 1, where it is actuated by a pair of camshafts having their axis parallel as described in the inventor's co-pending U.S. Pat. Ser. No. 07/496,651 hereinbefore referred to. FIG. 2 shows details of this patent to facilitate understanding of its application to the present invention. By way of description, the aforesaid patent discloses a mechanism to variably phase a pair of camshafts relative to crankshaft revolution, and relative to each other; and is particularly applicable to the present invention in that the parallel camshafts may be arranged with their axis close together; such being necessary if the elements of the present invention operatively linking the camshafts are to be kept within acceptable bounds of size and weight.

Camshafts 1 and 2, by actuation of the mechanism of the aforesaid invention, are capable of being advanced and retarded respectively while undergoing rotation in a common direction; camshaft 1, for instance, may be advanced relative to rotation, while camshaft 2 may simultaneously be retarded relative to rotation, thus providing jointly, an advanced camlobe flank to open a valve, and a retarded camlobe flank to close a valve, thereby providing means to extend valve duration.

In order to transmit to a valve, in a dynamically acceptable manner, the unsynchronised motion of the aforesaid camlobes, lever 5, pivoted about fulcrum 6 of tappet 7, has a first camfollower 3 engaging camlobe 1, and a second camfollower 4 engaging camlobe 2. Valve 8, driven by tappet 7 is biased to the closed position by spring means of per se well known type. Rotation of camlobes 1 and 2, driven by the engine crankshaft via per se well known means, displaces respectively camfollowers 3 and 4, causing valve 8 to be actuated. When camlobes 1 and 2 are maintained at identical phasing by the mechanism hereinbefore described, camfollowers 3 and 4 will be simultaneously displaced; lever 5 connecting the camfollowers will undergo no rotation about fulcrum 6 and the displacement of tappet 7 and valve 8 will be a direct reflection of the camlobe profiles.

Figure 3:
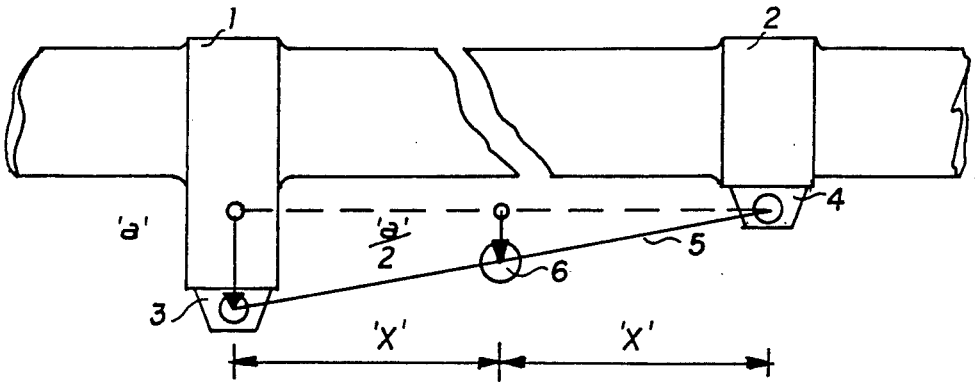
FIG. 3. Diagram showing geometric relationships of the present invention.

When, in order to extend valve duration, camlobe 1 is advanced relative to rotation, and camlobe 2 retarded relative to rotation, the opening flank of camlobe 1 will deflect camfollower section 3 of lever 5, while camfollower 4 will, by virtue of its being still in contact with the base circle of camlobe 2, undergo no deflection. Since fulcrum 6 of lever 5 is situated between deflected camfollower 3 and undeflected camlobe 4, it will undergo a deflection related to the ratio of the distances that exist between camfollower 3 and fulcrum 6, and camfollower 4 and fulcrum 6. If, preferably, the ratio is 1:1 (that is, the fulcrum 6 is situated midway between camfollowers 3 and 4), fulcrum 6 will undergo a deflection that is one half ($\frac{1}{2}$) of the deflection of camfollower 3. This relationship is depicted in FIG. 3. Valve deflection, in this case, therefore, will be half the deflection of camfollower 3.

As the camlobes 1 and 2 continue to undergo their normal rotation, the displacement of camfollower 3 will increase normally due to the camlobe profile, and the displacement of valve 8 will increase by half the amount of the displacement of camfollower 3. When however, sufficient camlobe rotation has taken place to bring the opening flank of retarded camlobe 2 into contact with camfollower 4, camfollower 4 will also undergo displacement, the displacement of tappet 7 and valve 8 now being related to the combined displacements of camfollowers 3 and 4.

As camshaft rotation continues, the valve 8 will be under the combined control of both camfollowers 3 and 4. When camlobe 1 has rotated sufficiently to once more bring its base circle into contact with camfollower 3, the closing phases of valve 8 will be solely under the control of the closing flank of camlobe 2; the deflection of tappet 7, and valve 8, being equal to half the deflection of camfollower 4; valve 8 reaching the closed position when camlobe 2 has rotated sufficiently for its base circle to contact camfollower 4. A full depiction of the relative motion between camfollowers 3 and 4 and valve 8 throughout a full lift cycle is shown diagramatically in FIG. 4.

Figure 4:
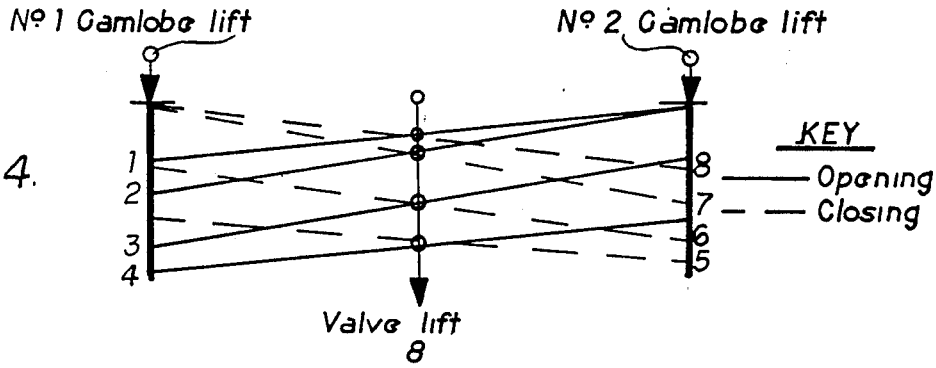
FIG. 4. Diagram showing further geometric relationships of the present invention.

FIG. 4 depicts the relative deflection of camfollowers 3 and 4 under control of camlobes 1 and 2 phased at 70 degree variance; this amount representing an increased valve duration of 70 degrees (crankshaft degrees) brought about by the advancing, relative to crankshaft revolution, of camlobe 1 by $17\frac{1}{2}$ degrees (camshaft degrees), and retardation relative to crankshaft revolution, of camlobe 2 by $17\frac{1}{2}$ degrees ($17\frac{1}{2}+17\frac{1}{2}\times 2=70$).

Figure 5:
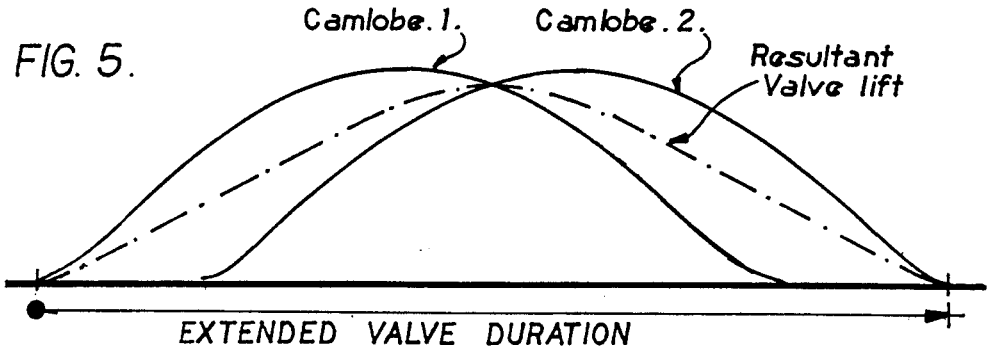
FIG. 5. Relative curves of camshaft lift and valve lift at an extended duration of the valve.

FIG. 5 depicts the resulting curve of valve lift. It will be noted that the aforesaid curve lacks the unevenness of the sample curve of valve lift of a valve controlled by a pair of camlobes at disparate phasing as depicted in FIG. 6 and discussed in the "Background of the Invention" section.

Figure 6:
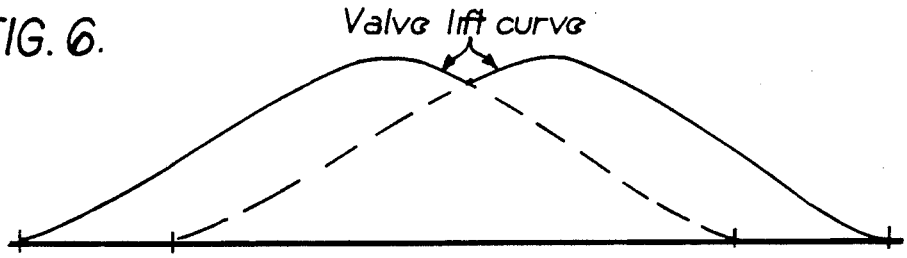
FIG. 6. Uneven curve of valve lift generated by two camlobes differentially phased.

Specifically, the uneven curve of valve lift depicted in FIG. 6 is due to the fact that each camlobe involved in actuating the valve achieves full lift at a different point in the valve lift curve; this being due to the differential phasing between the two camshafts. Consequently, the two points of maximum camshaft lift are transmitted directly to the valve, resulting in the FIG. 6 curve.

With the present invention, at no point in the rotation of either camlobe is full lift of a camlobe transmitted directly to the valve. Instead, while one camlobe may be at full lift, the lift at the valve is less than this amount, due to the fact that valve lift is always (except when the camlobes rotate with identical phasing) a compromise between the greater lift generated by one camlobe, and the lesser lift generated by the other camlobe. Therefore two "peaks" of maximum lift are not developed at the valve, and an acceptably smooth curve of valve lift occurs.

Figure 7:
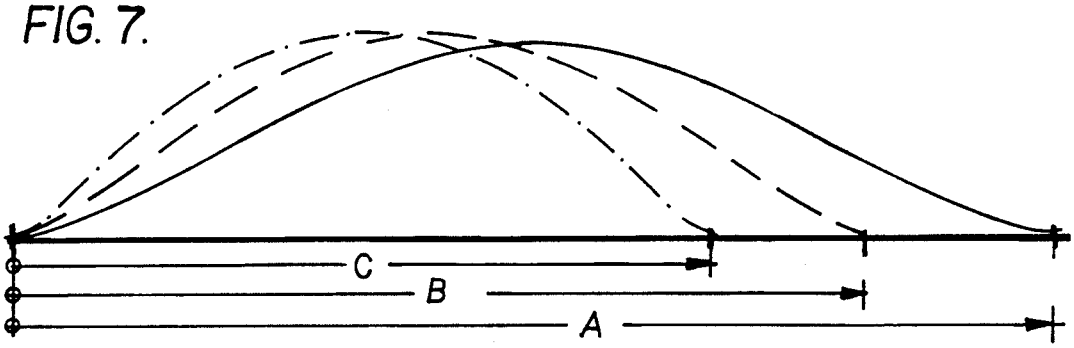
FIG. 7. Curves of valve lift as generated by the present invention at various durations.

It will be further noted that curves of valve lift 1, 2 and 3 in FIG. 7 result from application of the present invention to a pair of camlobes differentially phased to produce various durations of a valve. While curve "A" shows valve lift at maximum duration, curves "B" and "C" show valve lift at reduced durations, with increasingly steeper rates of valve opening and closing that occur progressively as valve duration is decreased to suit decreasing engine speed. Obviously, therefore, the present invention, applied as hereinbefore discussed, will produce continuously variable rates of valve opening and closing throughout the whole range of valve duration as adjusted to suit varying engine speeds.

It is important to note that the appropriate camlobe profiles for use with the present invention would be designed for an optimum valve lift curve at maximum duration achievable by the mechanism, and that this duration would be at maximum engine speed. It would be seen, in this case, that at lesser durations necessitated by reduced engine speeds, the rates of valve opening and closing would increase commensurately.

Figure 8:
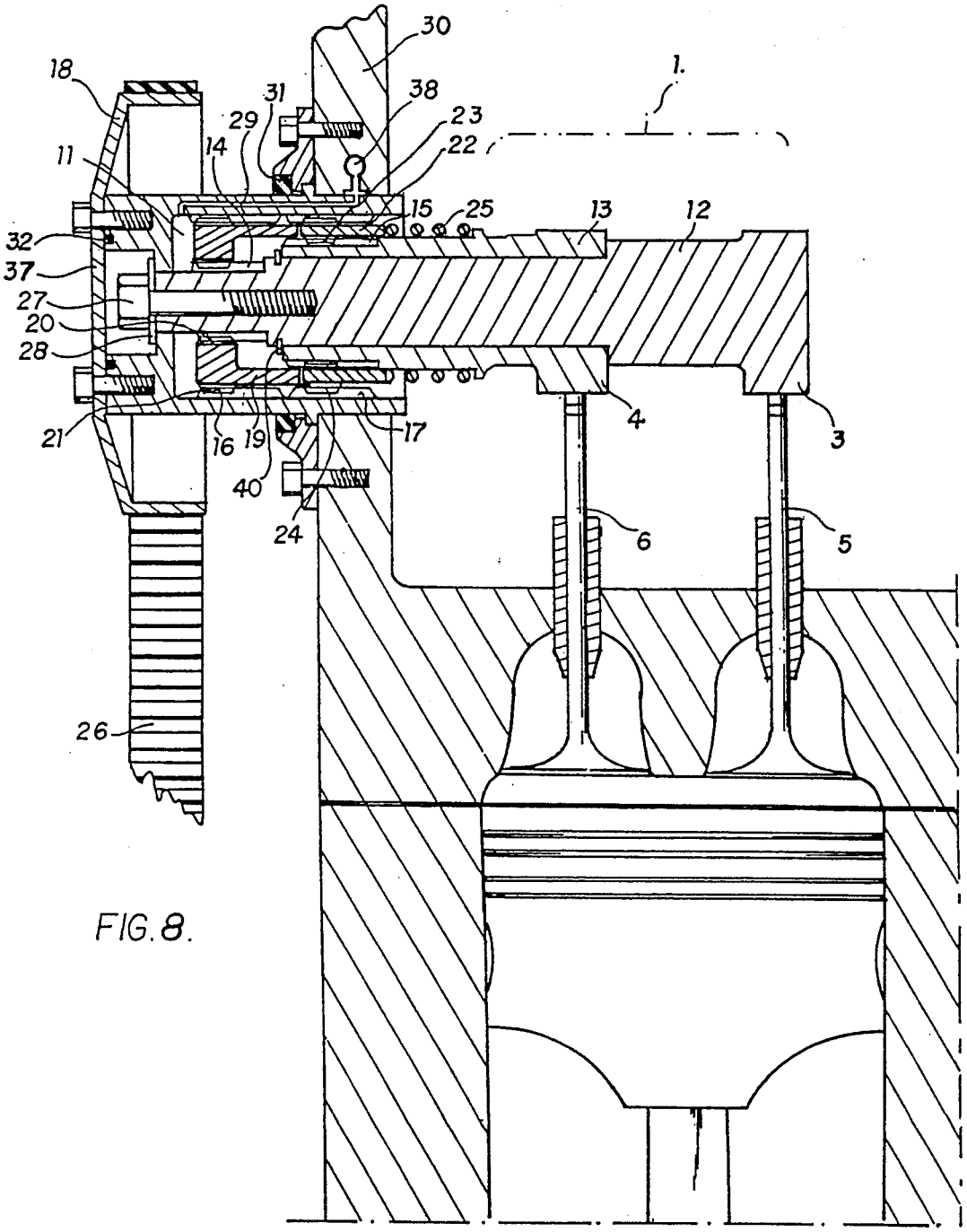
FIG. 8. Prior Art mechanism of the type suitable to actuate the present invention.

Another embodiment of the present invention is shown in FIG. 8 "Prior Art". In this case, the required pair of camlobes capable of variable phasing relative to each other and to the engine crankshaft are provided by the mechanism as disclosed in the inventor's co-pending application Ser. No. 07/544,180 wherein the aforesaid camlobes share a common axis on the camshaft.

In the following description it will be noted that the same numbers are applied to the same elements where the same elements appear in different embodiments.

Figure 9:
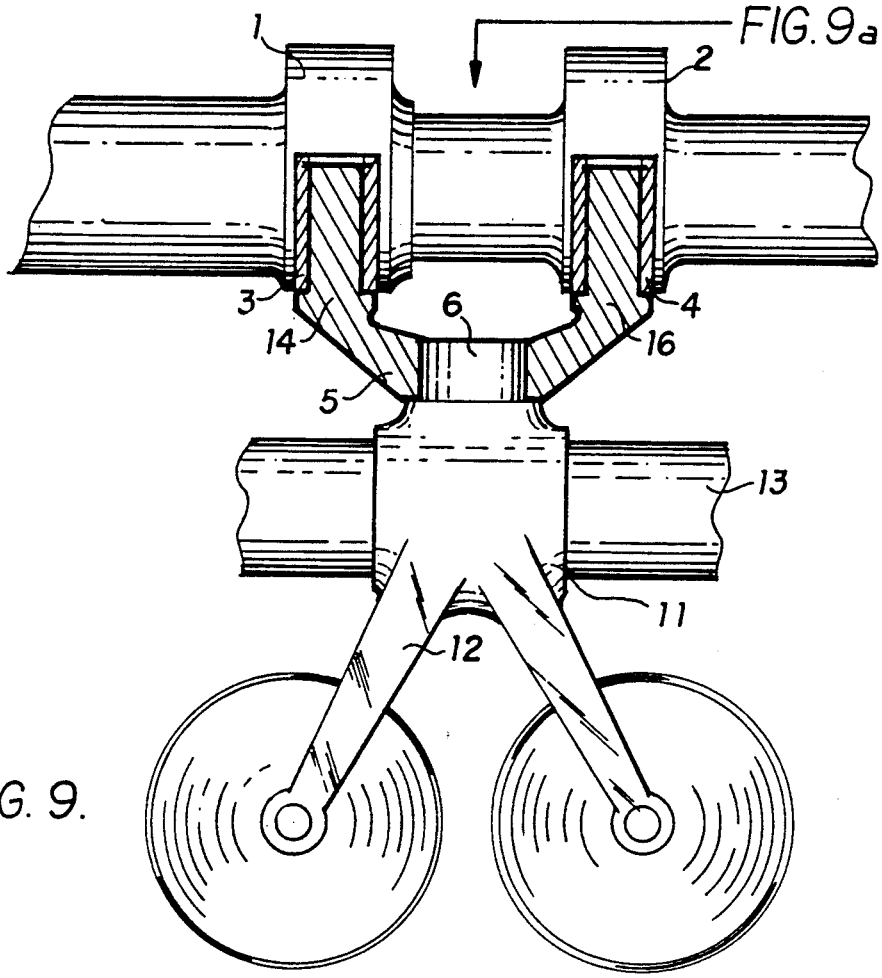
FIGS. 9 and 9A. Different part sectional views of an alternative version of the present invention.
Figure 9A:
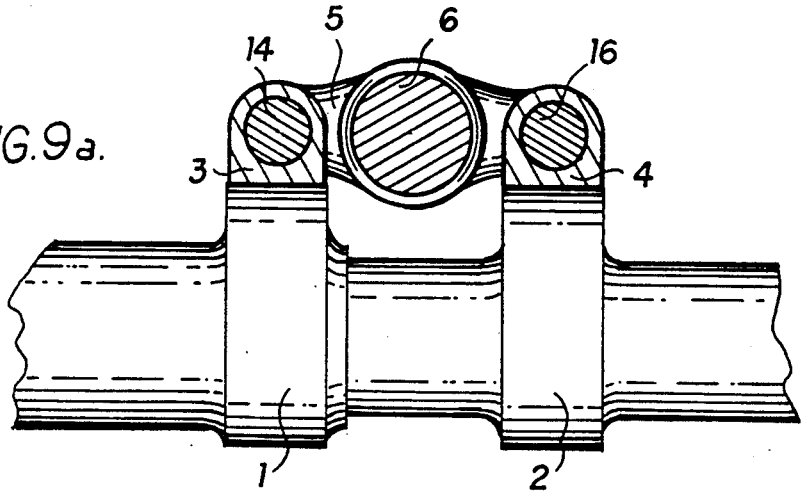

Camfollowers 3 and 4 engage, respectively, camlobes 1 and 2, and are provided with means to correctly engage their respective camlobes by virtue of being rotatably mounted to extensions 14 and 16 of lever 5 connecting them. Lever 5 rotates about a fulcrum 6 formed by portions of valve actuating member 11. Valve actuating member 11 rotates about a fulcrum 13, and has an extension 12 to operate a valve 8. It should be noted that by means of a suitable number of such extensions, a number of valves may be simultaneously actuated within a combustion chamber. See FIG. 9.

As described in the previous embodiment, rotation of camlobes 1 and 2 at differential phasing causes, for example, advanced camlobe 1 to contact camfollower 3 while camfollower 4 is still under control of the base circle of retarded camlobe 2. Camfollower 3, therefore, will be displaced by camlobe 1, while camfollower 4 undergoes no displacement. Lever 5 therefore will be forced to rotate about its fulcrum 6 in order to accommodate the resulting rocking motion of first lever 5. Displacement of either, or both, camfollowers 3 and 4 causes rotation of second lever 11 about fulcrum 13, this rotational displacement being related to the sum of the displacement of both camfollowers divided by 2. Therefore valve lift actuated by this embodiment of the present invention is, as with the previously described embodiment, proportional to the sum of the displacement of both camfollowers divided by 2.

Figure 11:
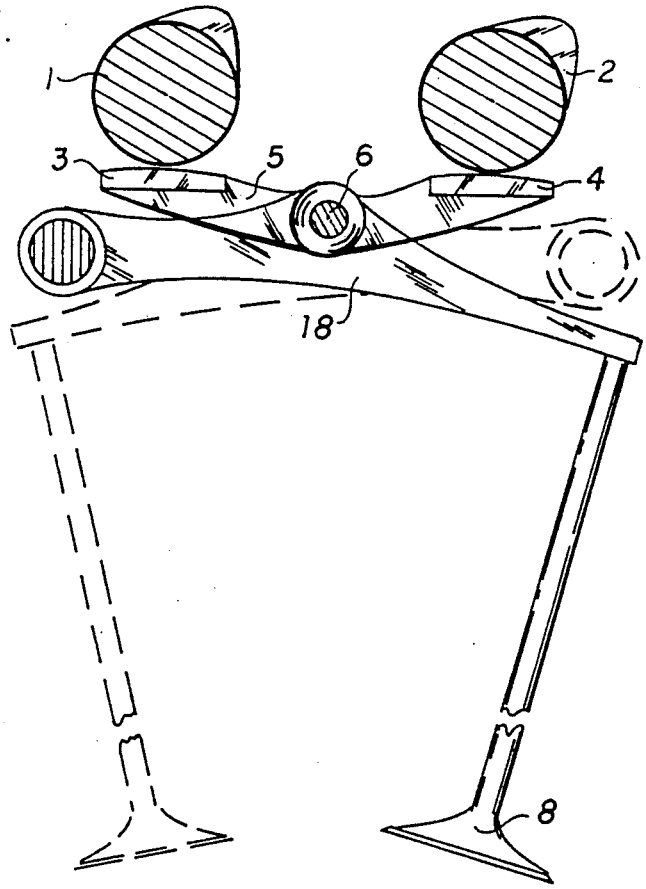
FIG. 11. A yet further version of the present invention.

A third embodiment of the present invention is shown in FIG. 11 wherein lever 5 carrying camfollowers 3 and 4 is rotatable about a fulcrum 6 carried by a lever 18 rotatable about a fulcrum 9. Lift of valve 8 is, with this arrangement, determined by the geometric and distance relationships that exist between the various levers and fulcrums.

Figure 10:
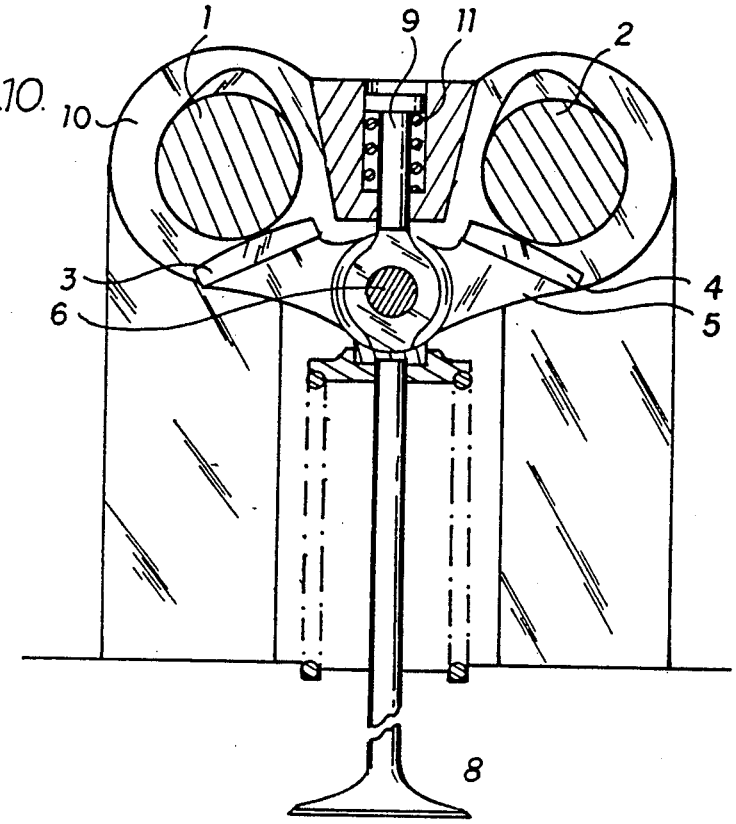
FIG. 10. A further version of the present invention.

A fourth embodiment of the present invention is shown in FIG. 10 wherein lever 5 carrying camfollowers 3 and 4 is mounted rotatably about fulcrum 6 of a member 9 reciprocatively received within housing 10. Biasing spring 11 maintains contact between camlobes 1 and 2 and camfollowers 3 and 4 respectively. The transmittal of motion is the same as with the other embodiments mentioned herein.

Figure 12:
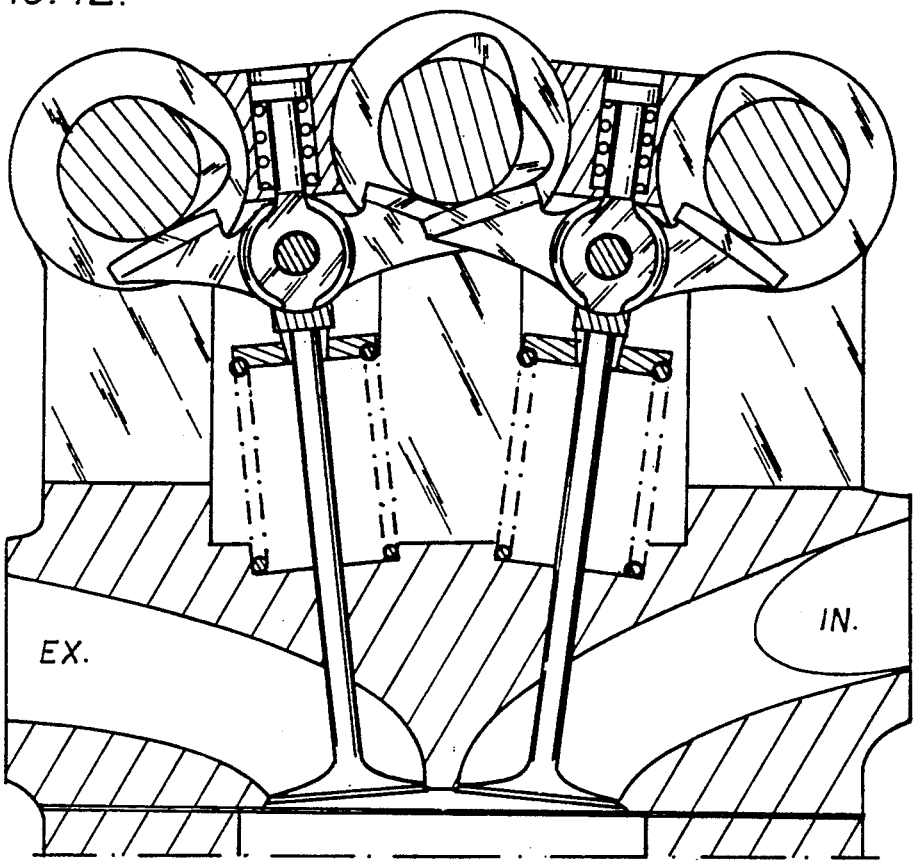
FIG. 12. A further application of the present invention using three camshafts.
Figure 13:
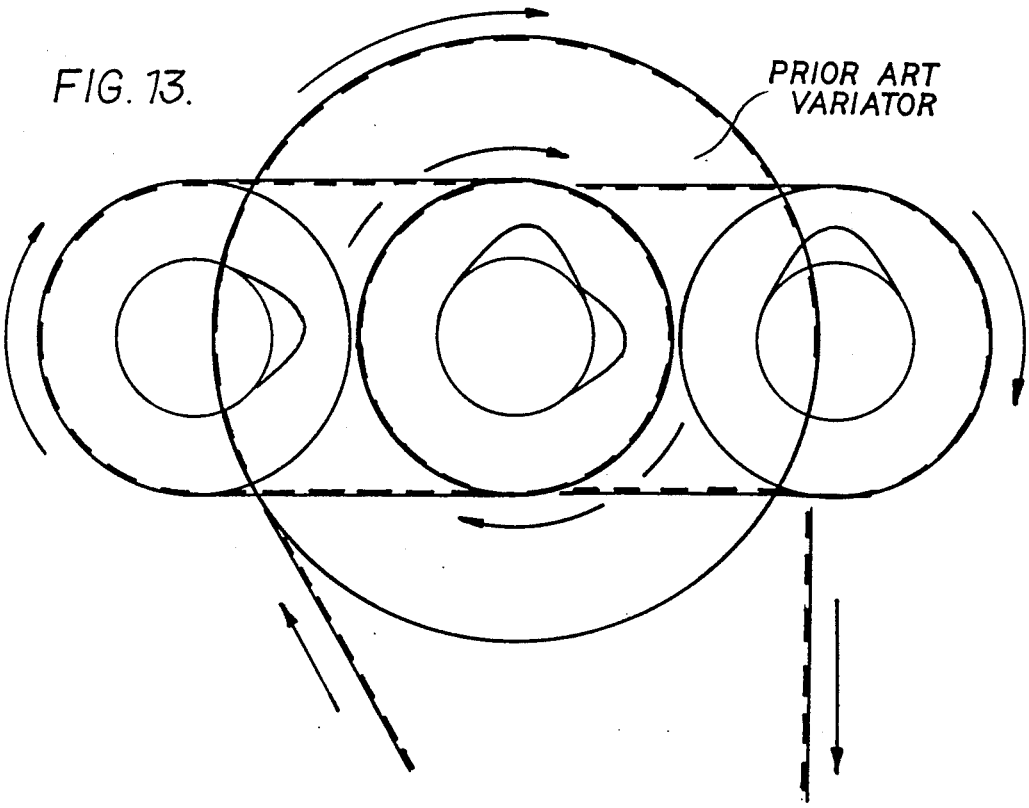
FIG. 13. Frontal elevation diagram of a Prior Art variator adapted to actuate the application of the present invention shown in FIG. 12.

A further embodiment of the present invention is shown in FIGS. 12 and 13, in which the mechanism shown in FIG. 10 is combined for purposes of illustration with PRIOR ART mechanism shown in FIG. 2.

It is an aspect of the above embodiments that the curve of valve lift may be modified by altering the distance relationship that exists between the camfollowers 3 and 4 and fulcrum 6; when the fulcrum 6 is biased towards the rotationally advanced camlobe, the rate of valve opening will be increased relative to the rate of valve closing. Conversely, biasing of fulcrum 6 towards the rotationally retarded camlobe results in a rate of valve closing steeper than the rate of valve opening.

It is a further aspect of the present invention that it is innate in the geometry of the hereinbefore described mechanism that rates of valve opening and closing increase as engine speed (and therefore valve duration) decreases. Valve accelerations, however, at no point increase beyond those realised at maximum engine speed.

It is a further aspect of the present invention that camfollowers may, where appropriate, be rollers of per se well known type.

It should be noted that the present invention may have applications beyond those related to internal combustion engines as hereinbefore described.

The foregoing description of the preferred embodiment of the invention has been presented for the purposes of illustration and description. It is not intended to be exhaustive or to limit the invention to the precise form disclosed. Many modifications and variations are possible in the light of the above teaching. It is intended that the scope of the invention be limited not by this detailed description, but rather by the claims appended hereto.

What is claimed is:

1. A mechanism to combine the displacement of a first camlobe and the displacement of a second camlobe, said camlobes rotating at variable relative phasings, so as to cooperatively actuate, at variable durations, a valve in the combustion chamber of an internal combustion engine, comprising:

a first lever means;

said first lever means having first and second camfollower means to engage operatively said first and second camlobes respectively, and first fulcrum means to locate rotatably a means to engage operatively said valve;

said rotation of said first and second camlobes displacing at least one of said camfollower means;

said displacement of at least one of said camfollower means causing rotation of said first lever means;

said rotation of said first lever means displacing said first fulcrum means of said first lever means locating rotatably said means to engage operatively said valve, so as to displace said means to engage operatively said valve;

said displacement of said means to engage operatively said valve actuating said valve.

2. The mechanism as in claim 1 wherein said means to engage operatively said valve comprises:

a bucket tappet means;

said bucket tappet means having means to rotatably locate said first lever means.

3. The mechanism as in claim 1, wherein said means to engage operatively said valve comprises:

a second lever means;

a second fulcrum means;

said second lever means having an axis of rotation about said second fulcrum means substantially at right angles to the axis of rotation of said first lever means.

4. The mechanism as in claim 1, wherein said means to engage operatively said valve comprises:

a member reciprocatively received in a housing fixed relative to said engine and having means to locate rotationally said first lever means.

5. The mechanism as in claim 4, further comprising:

said member reciprocatively received in a housing fixed relative to said engine having means to bias said first and second camfollower means of said first lever means into sliding engagement with said first and second camlobes respectively.

6. The mechanism as in claim 5 further comprising:

said first lever means engaging operatively said valve.

7. The mechanism as in claim 3 further comprising:

means to maintain correct engagement between said first and second camlobes, and said first and second camfollower means respectively.

* * * * *